US005869817A

United States Patent [19]

Zietlow et al.

[11] Patent Number: 5,869,817

[45] Date of Patent: Feb. 9, 1999

[54] TUNABLE CAVITY MICROWAVE APPLICATOR

[75] Inventors: Douglas A. Zietlow, Anoka; Terry G. Reishus, Eagan, both of Minn.

[73] Assignee: General Mills, Inc., Minneapolis, Minn.

[21] Appl. No.: 813,818

[22] Filed: Mar. 6, 1997

[51] Int. Cl.[6] ..... H05B 6/70

[52] U.S. Cl. ..... 219/696; 219/690; 219/749; 219/754

[58] Field of Search ..... 219/690–693, 219/695, 696, 709, 745, 749, 750, 754; 333/209, 220–225

[56] References Cited

U.S. PATENT DOCUMENTS

| | | | |
|---|---|---|---|
| 3,413,577 | 11/1968 | Massano | 333/226 |
| 4,129,768 | 12/1978 | Anderson | 219/10.55 A |
| 4,251,787 | 2/1981 | Young et al. | 333/209 |
| 4,714,812 | 12/1987 | Haagensen et al. | 219/10.55 F |
| 4,889,965 | 12/1989 | Gervais et al. | 219/750 |
| 5,250,773 | 10/1993 | Lind et al. | 219/750 |
| 5,400,524 | 3/1995 | Leconte et al. | 34/259 |
| 5,471,037 | 11/1995 | Goethel et al. | 219/750 |

*Primary Examiner*—Tu Ba Hoang
*Attorney, Agent, or Firm*—John A. O'Toole; Alan D. Kamrath; John M. Haurykiewicz

[57] ABSTRACT

A microwave applicator (10) including a tunable cavity (12) having by an elongated casing formed from a transition section (14) axially secured between upstream and downstream end sections (16) and by first and second end assemblies (28) each axially movable in the elongated casing. A tube assembly (72) passes through and is rotatably supported within tubes (36) of the end assemblies (28) and passes through the elongated casing. Material in the tube assembly (72) in the elongated casing and between the end assemblies (28) are subjected to microwave power introduced into the transition section (14) by a waveguide (110) via an opening 20. The axis of the tube assembly (72) is adjustably offset from that of the elongated casing and the transition section (14) is adjustably fixed at various circumferential positions to superimpose the material bed in the tube assembly (72) with the area of highest field strength. Material is introduced into the tube assembly (72) by an auger (90) having holes (92) in the spiral flight above the material to allow air to flow concurrently with the material in the auger (90) and in the tube assembly (72). The tube assembly (72) includes a tube (74) formed by sections (74A, 74B) interconnected together by generally T-shaped extensions (132, 133) which interfit in generally T-shaped slots (120, 121) formed on the axial ends of the sections (74A, 74B). A control system (170) is used to adjust operating parameters for the applicator and includes a generator (146), a network analyzer (148), a microwave switch (152), a dual directional coupler (164) and an impedance matching device (112). A method of adjusting the applicator (10) to overcouple the microwave energy to the cavity (12) includes adjusting the end assemblies (28) and an impedance matching device (112) while minimizing the reflected power.

43 Claims, 8 Drawing Sheets

TUNABLE CAVITY MICROWAVE APPLICATOR

FIELD OF THE INVENTION

The present invention relates to the field of microwave applicators, more particularly to microwave applicators for high power, continuous process, industrial use, more particularly to continuous duty, tunable cavity microwave applicators.

BACKGROUND OF THE INVENTION

In the past, it has been observed that microwave heating (i.e., temperature rise of a load) is related to its thermal properties, its dielectric properties (at the frequency of operation), and the extent that microwave energy is coupled to the load, microwave propagation into the load is affected by reflections due to impedance mismatches, and diffraction due to geometrical curvature of such mismatches. All the mentioned parameters are of use to control heating rate.

Controlling microwave absorption by manipulating material composition is possible to some extent, but it is difficult and has limitations, which are sometimes severe. The thermal and dielectric properties are functions of the material composition, and are often interdependent. Other requirements may constrain the material composition; therefore, controlling microwave absorption by manipulating material composition has limited utility.

Controlling microwave absorption with frequency is impractical because the frequencies for industrial, scientific, and medical uses are mandated to 915 and 2450 MHz by law.

The microwave applicator design is the primary method available in practice to control heating. To have high efficiency, it is necessary to minimize energy reflected back to the microwave generator.

Coupling is the degree to which energy is delivered from the feed structure to the cavity compared to the energy reflected back from the cavity to the feed structure. A "matched" condition where the delivered energy balances the reflected energy and no power is returned to the generator is termed critical coupling. This principle can also be applied to the free space field-load interface within the cavity. Critical coupling here allows the greatest microwave field strength in the material to be created, thereby allowing the highest microwave heating rate possible.

The coupling factor is normally defined by an equivalent lumped circuit model of cavity behavior, as the quotient between the feed impedance as seen from the cavity and the combined cavity and load impedance as seen from the feed. The former can be controlled by mechanical changes of the coupling port. The latter is determined by the mode type in the cavity, and by the geometry and dielectric properties of the load. If the load has a low (relative) loss factor $\epsilon''$ the latter generally becomes large. When these impedances are equal, critical coupling occurs and the coupling factor is 1. Thus, manipulation of the coupling is the most efficient way of optimizing the overall heating efficiency with any load in the cavity. Furthermore, it can easily be measured by replacing the magnetron generator by microwave instrumentation incorporating a variable frequency generator and means such as directional detector for measuring the reflected power as a function of the input frequency. Both the resonance bandwidth and the coupling factor can then be easily quantified, and observed continuously on the instrument display during changes of the coupling and other parameters. However, any influence by the dynamic temperature dependence of the dielectric properties of the load cannot be studied directly, since the instrumentation generator power is only in the order of milliwatts.

Of course, varying the generator power output provides an additional means for controlling the load power. Industrial size variable power generators are commercially available and quite reliable. It is therefore possible to set the optimum load power at or near the favorable critical coupling condition.

Most resonant cavities described in the literature are of fixed geometry. If the geometry and dielectric properties of the load material vary substantially, and the same installation is to be used under such strongly variable conditions, the option of changing some cavity dimensions becomes interesting. In particular, relatively low-loss loads create a relatively high quality factor (Q value) which in turn results in a narrow bandwidth of the cavity resonance, which in turn may make it necessary to change the cavity dimensions since the frequency of operation is fixed. This is called cavity tuning, and is not to be confused with the feed port changes, which is called impedance tuning. The former changes the resonant frequency, and the latter changes the coupling factor. They are essentially independent.

In the literature, most tunable resonant cavities for microwave heating have limited tuning ability. Various methods have been employed for tuning including a single moveable end wall to change the cavity length, movable coaxial antennas, stubs and tubes. Most tunable resonant cavities have been designed for batch processing, usually for small quantities of material. Correspondingly, most tunable resonant cavity systems are low power, i.e. less than 10 kW.

U.S. Pat. No. 4,714,812 discloses a tunable cavity having one movable wall that overcomes many of the shortcomings of other designs for high power, continuous process, industrial use. The cavity of this patent has a movable piston at one end of a cylindrical cavity through which product flows in a vertically arranged dielectric tube while being subjected to microwave energy. At least two of these cavities are used together in series to form a working system. The first cavity heats the material and the second cavity monitors the material condition. Power is transmitted to the first cavity through a coaxial transmission line. The maximum power delivered to the first cavity is 5 kW. The movable piston in the first cavity is positioned to maximize the forward power into and minimize the reflected power out of the first cavity. The second cavity is used to determine the material condition by adjusting the cavity length to provide significant reflected power, and then using the reflected power to indicate the state or value of the material property of interest, for instance the moisture. A controller adjusts the power applied to the first cavity based on the monitored value of the second cavity. Liberated moisture is removed from the system in a third unit where crossflow air is passed through perforations formed in the vertical plastic tube carrying the material.

However, a need continues to exist for microwave applicators achieving higher heating rates than existing continuous, industrial microwave applicators and which overcome the shortcomings of such existing applicators.

SUMMARY

This need and other problems in the field of microwave applicators and methods have been solved by providing, in the preferred form, a tunable cavity including first and second walls which are both axially movable within an elongated casing, with material continuously moving through the tunable cavity being subjected to microwave power introduced into the elongated casing between the walls in a manner to couple the microwave power to the tunable cavity.

In preferred aspects of the present invention to superimpose the material with the highest field strength of the microwave power, the material moving through the tunable cavity is adjustably positioned in the elongated casing and the microwave power can be introduced at adjustable, circumferential positions about the moving material.

In other aspects of the present invention, a tube assembly for moving the material through the tunable cavity is formed from sections interconnected together by generally T-shaped extensions which interfit with generally T-shaped slots formed on the axial ends of the sections.

In still other aspects of the present invention, air moves concurrently through the tube assembly with the material to be processed, with the air being introduced through holes formed in the spiral flight of the auger which introduces the material into the tube assembly.

It is thus an object of the present invention to provide a novel microwave applicator.

It is further an object of the present invention to provide such a novel microwave applicator for high power, continuous process, industrial use.

It is further an object of the present invention to provide such a novel microwave applicator having a tunable cavity.

It is further an object of the present invention to provide such a novel microwave applicator having a tunable resonant cavity.

It is further an object of the present invention to provide such a novel microwave applicator having high heating rates.

It is further an object of the present invention to provide such a novel microwave applicator providing precise temperature control.

It is further an object of the present invention to provide such a novel microwave applicator which is flexible in the types of material to be processed including but not limited to a gas, liquid, solid, fluid, slurry, semisolid, or plasma material.

It is further an object of the present invention to provide such a novel microwave applicator which has a small floor space footprint and volume.

It is further an object of the present invention to provide such a novel microwave applicator achieving higher heating rates than conventional continuous industrial microwave equipment.

It is further an object of the present invention to provide such a novel microwave applicator achieving high heating efficiencies.

It is further an object of the present invention to provide such a novel microwave applicator which precisely controls the heating rate and final temperature of the materials.

It is further an object of the present invention to provide such a novel microwave applicator able to heat low loss and difficult to heat materials efficiently.

It is further an object of the present invention to provide such a novel microwave applicator able to efficiently process a broad range of materials for a specific result from among a broad range of objectives including but not limited to sensible heating, phase changes, chemical reactions, or ionization, such as drying, puffing, cooking, toasting, dissolution, sintering, calcining, vulcanizing, digesting, sterilizing, or combination of the same.

It is further an object of the present invention to provide such a novel microwave applicator of a relatively simple design.

It is further an object of the present invention to provide such a novel microwave applicator whose capital cost is comparable to or less than conventional microwave systems.

It is further an object of the present invention to provide such a novel microwave applicator whose operating costs are comparable to or less than conventional heating systems including microwave systems.

It is further an object of the present invention to provide such a novel microwave applicator of a modular construction.

These and further objects and advantages of the present invention will become clearer in light of the following detailed description of an illustrative embodiment of this invention described in connection with the drawings.

BRIEF DESCRIPTION OF THE DRAWINGS

The illustrative embodiment may best be described by reference to the accompanying drawings where.

Figure 1A:
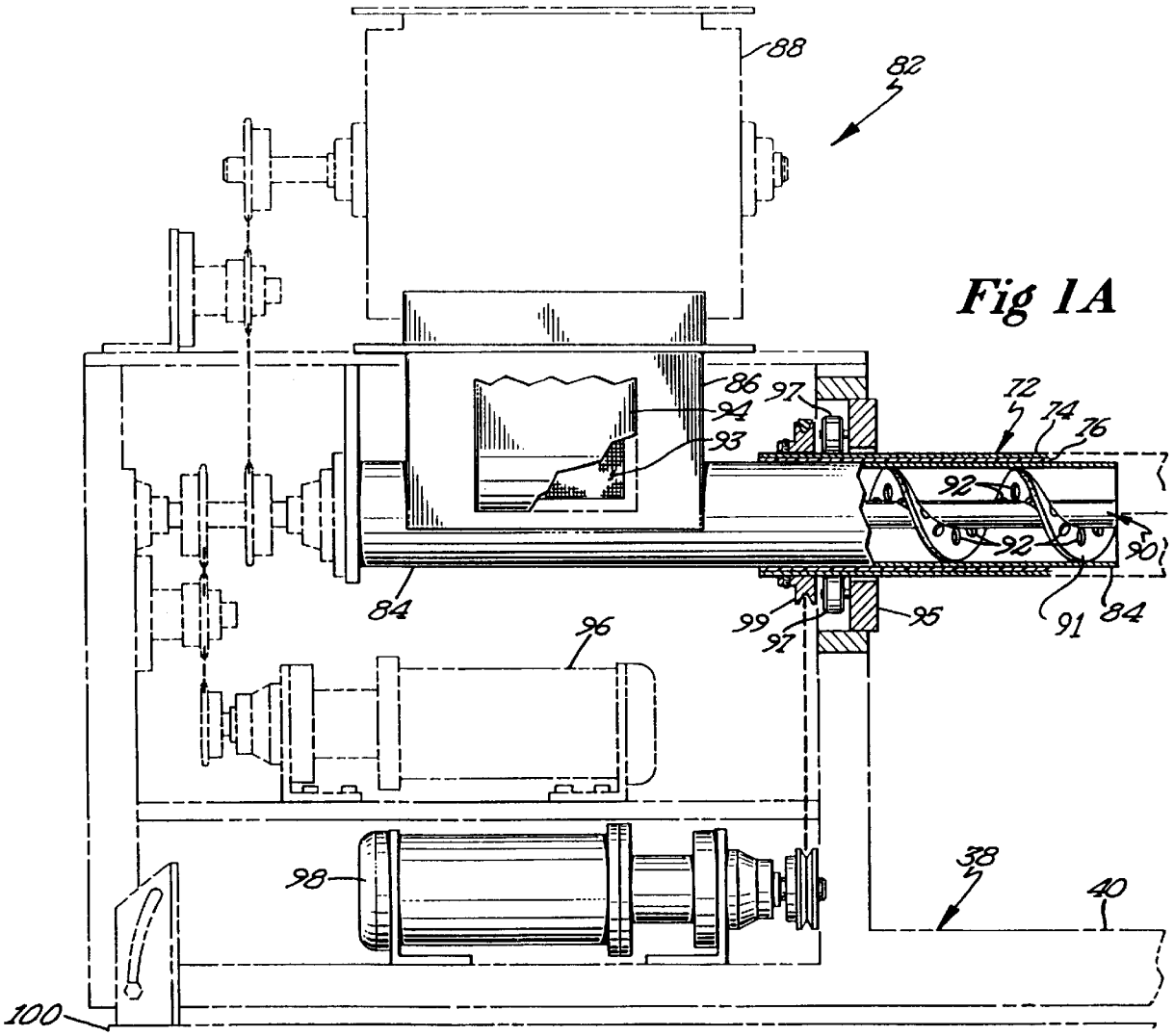
FIG. 1 shows a side view of a tunable cavity microwave applicator according to the preferred teachings of the present invention in three axial sections labeled 1A, 1B, and 1C, with portions shown in phantom and with other portions being broken away to show constructional details, and with FIG. 1C shown in a smaller scale than that used for FIGS. 1A and 1B.
Figure 1B:
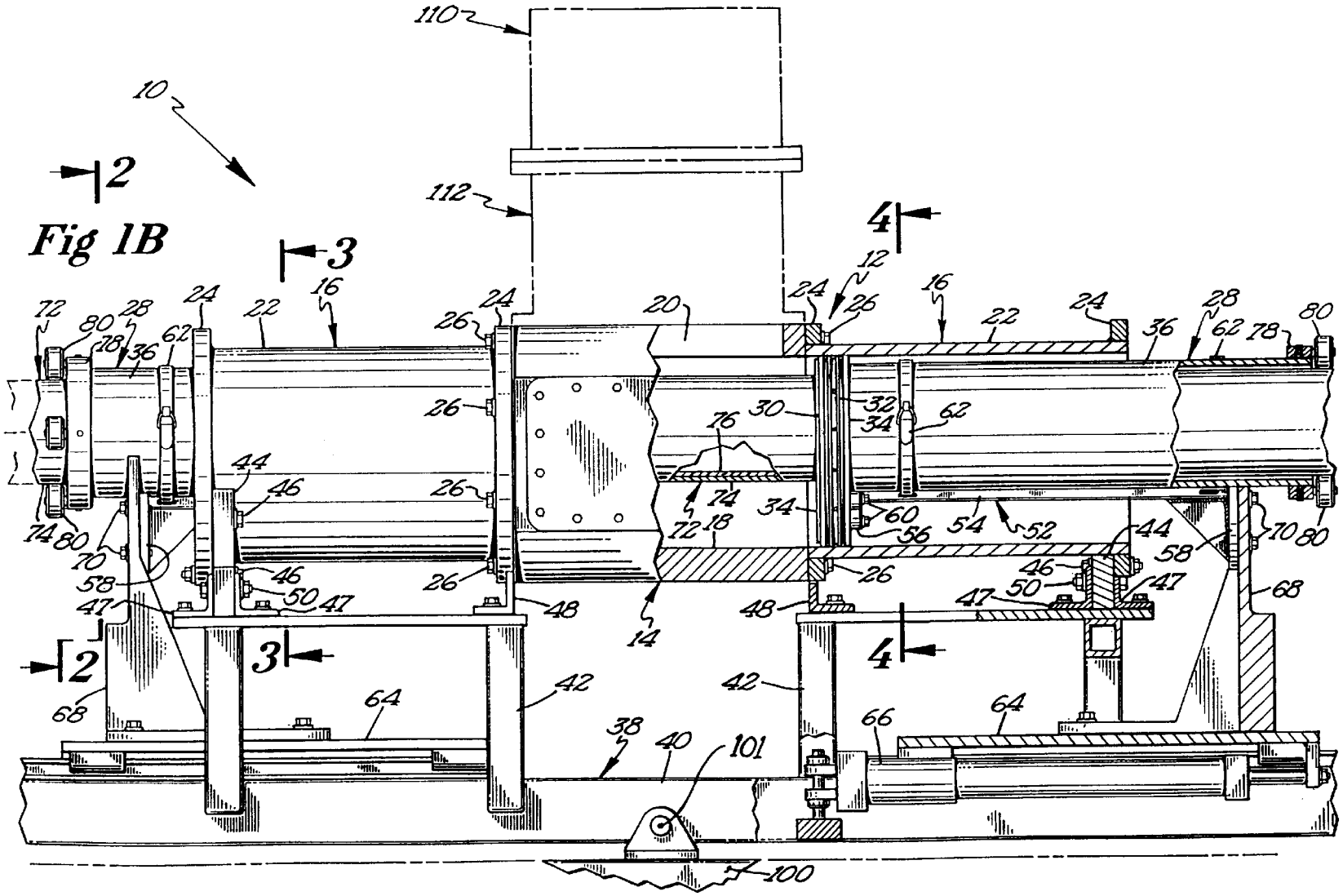
Figure 1C:
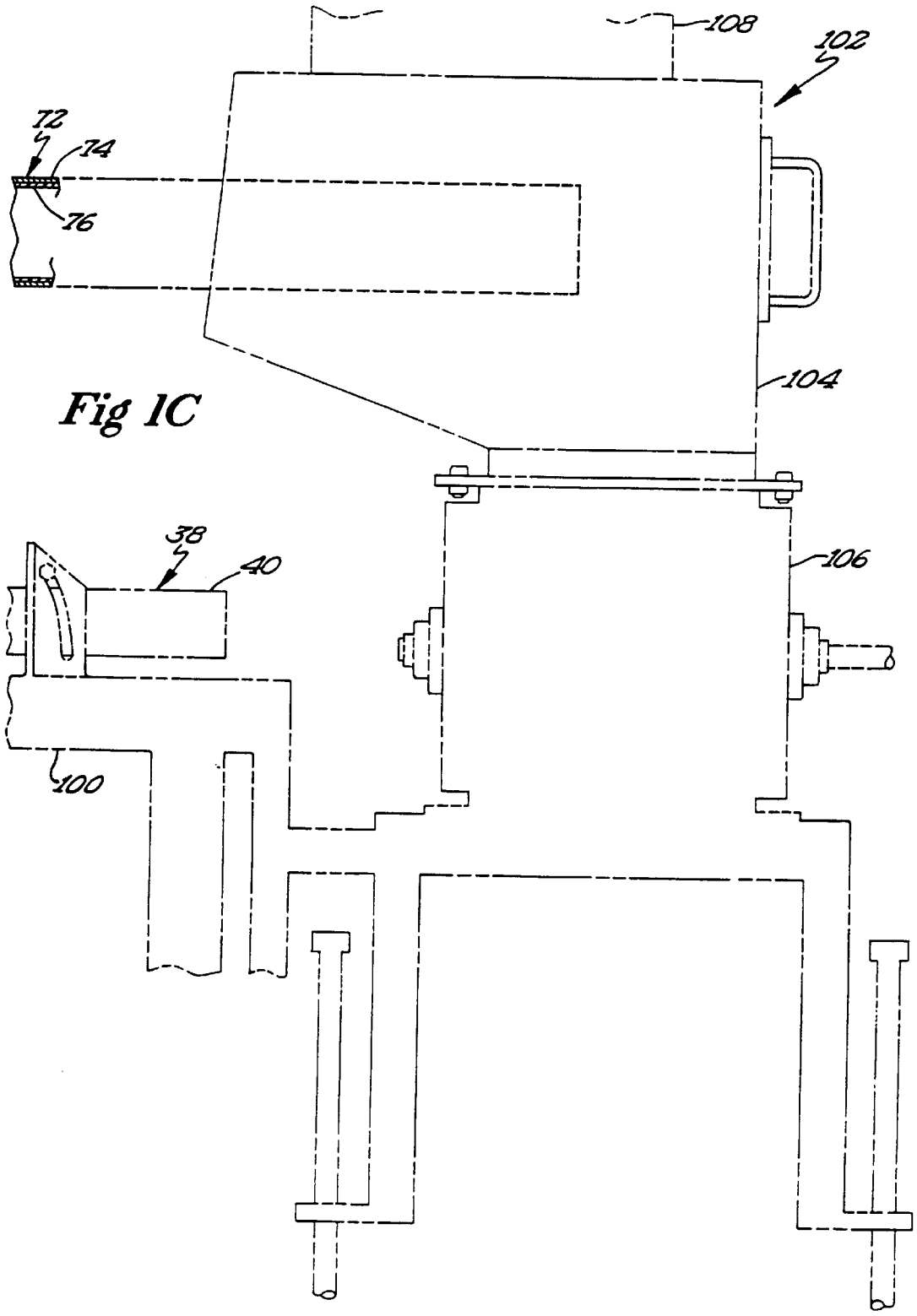
Figure 2:
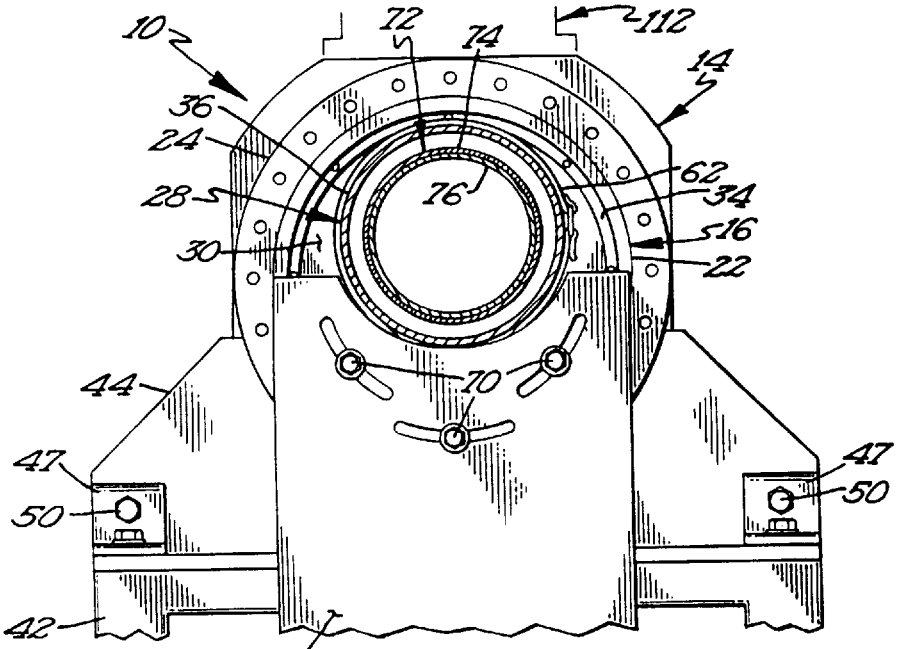
FIG. 2 shows a cross-sectional view of the tunable cavity microwave applicator of FIG. 1 according to section line 2—2 of FIG. 1B.
Figure 3:
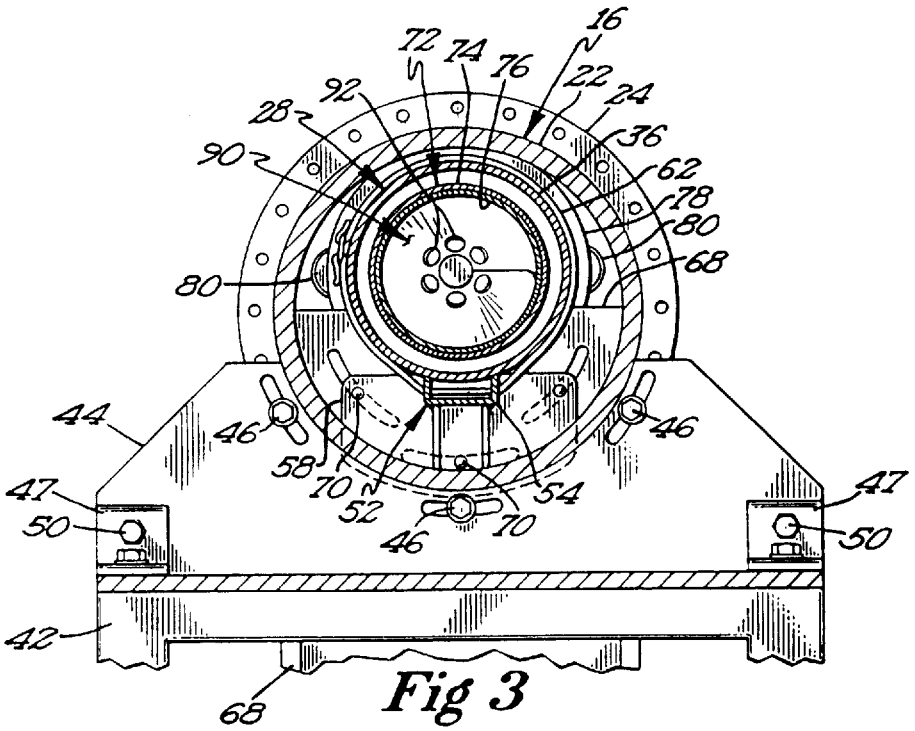
FIG. 3 shows a cross-sectional view of the tunable cavity microwave applicator of FIG. 1 according to section line 3—3 of FIG. 1B.
Figure 4:
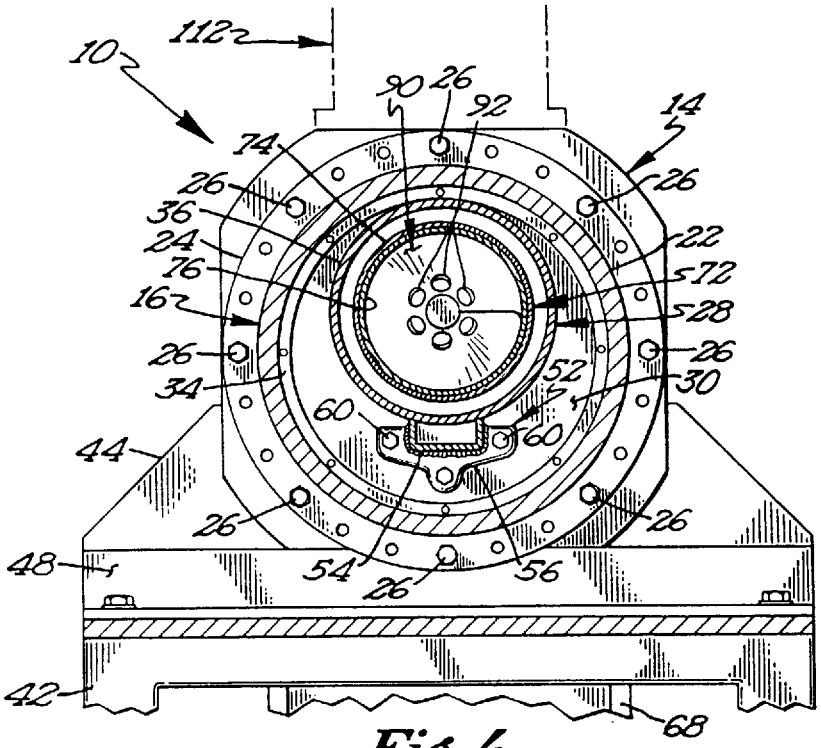
FIG. 4 shows a cross-sectional view of the tunable cavity microwave applicator of FIG. 1 according to section line 4—4 of FIG. 1B.

All figures are drawn for ease of explanation of the basic teachings of the present invention only; the extensions of the Figures with respect to number, position, relationship, and dimensions of the parts to form the preferred embodiment will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various figures of the drawings, the same numerals designate the same or similar parts. Furthermore, when the terms "top", "bottom", "first", "second", "inside", "outside", "front", "back", "outer", "inner", "upper", "lower", "height", "width", "length", "end", "side", "horizontal", "vertical", "axial", "radial", "longitudinal", "lateral", and similar terms are used herein, it should be understood that these terms have reference only to the structure shown in the drawings as it would appear to a person viewing the drawings and are utilized only to facilitate describing the illustrative embodiment.

DETAILED DESCRIPTION

A continuous duty tunable cavity microwave applicator according to the preferred teachings of the present invention is shown in the drawings and generally designated 10. Generally, applicator 10 includes a tunable cavity 12 formed in the preferred form from a transition section 14 and first and second end sections 16 secured on the opposite axial ends of transition section 14. In the most preferred form, transition section 14 is machined from a block having square cross sections and a length of approximately 13.75 inches (34.9 cm). An inner bore 18 is machined generally axially through the block, with bore 18 in the most preferred form having circular cross sections of a diameter of approximately 9 inches (22.9 cm). However, bore 18 could have cross sections of elliptical, rectangular or any other shape that would support one or more microwave modes therein. A waveguide opening 20 is machined extending from one side of the block and intersecting with bore 18, with the long side of wave-guide opening 20 being parallel to the axis of bore 18 and the block. In the most preferred form, the corners of the block are turned off at a diameter greater than the dimensional length of the sides of the block. Additionally, threaded inserts are placed in a circular pattern on each of the ends of the block and outside and concentric to bore 18.

As shown in the drawings, transition section 14 can include other openings machined extending from the other sides of the block and intersecting with bore 18. Such openings could include suitable provisions for viewing the microwave heating of material within bore 18. Similarly, such openings could provide access for additional waveguides when further microwave power is desired in bore 18.

In the most preferred form, end sections 16 are formed of sleeves or tubes 22 including an inside surface having a shape and size corresponding to bore 18. Flanges 24 are secured to the opposite axial ends of each of the tubes 22, with the outer periphery of flanges 24 having a size generally equal to the dimensional length of the sides of the block forming transition section 14. In the most preferred form, end sections 16 are of identical construction and have a length of approximately 15 inches (38 cm). End sections 16 are secured to transition section 14 in the most preferred form by bolts 26 extending through circumferentially spaced, axially extending apertures formed in flanges 24 and threaded into the inserts in the ends of transition section 14.

Suitable shoulders can be formed in sections 14 and/or 16 to align the inside surfaces of sections 14 and 16 when secured together. It should then be appreciated that sections 14 and 16 secured together form an elongated casing including upstream and downstream axially outer ends defined by the axially outer flanges 24 of end sections 16. In the most preferred form, sections 14 and 16 are formed of aluminum.

Applicator 10 according to the preferred teachings of the present invention further includes first and second movable end assemblies 28 formed in the preferred form of aluminum. Generally, each end assembly 28 includes a movable wall or plate 30 having an outer periphery of a shape and size corresponding to and for slideable receipt within tubes 22 and bore 18. Suitable provisions are provided for allowing plates 30 to move axially within tubes 22 and bore 18 while providing electrical continuity between the inner surfaces of tubes 22 and bore 18 and the outer periphery of plate 30. In the most preferred form, a spring 32 formed from copper beryllium with generally U-shaped cross sections is attached to the outer periphery of plate 30 for slideable contact with the inner surfaces of tubes 22 and bore 18. Further, flat, annular Teflon rings or plates 34 are secured on the opposite sides of plates 30 and having outer peripheries extending generally radially outwardly beyond the outer periphery of plate 30 for direct slideable abutment with the inner surfaces of tubes 22 and bore 18, with annular plates 34 protecting spring 32, providing a physical seal between plate 30 and tubes 22 and bore 18, and keeping spring 32 and bore 18 and the inner surfaces of tubes 22 clean, thereby helping insure good electrical contact.

End assemblies 28 each further generally include a cylindrical member or tube 36 having a size smaller than tubes 22 and bore 18 and in the most preferred form of a cylindrical shape having an outside diameter of 6 inches (15 cm) and an inside diameter of 5.375 inches (13.7 cm). Each of tubes 36 is relieved to an internal diameter of 5.5 inches (14 cm) for a length of 16 inches (40.6 cm) from the interior surface of wall 30 to accommodate collar 136 over tube 74 (see FIGS. 6 and 7). Alternatively, one or both of tubes 36 may have an internal diameter of 5.5 inches (14 cm) extending throughout to ease installation of the assembly of tube 74 and collar 136 into the applicator 10. Tubes 36 are attached to plates 30 with the axis of tubes 36 being offset from the axis of plates 30. Plates 30 each have an axial bore extending therethrough of a size, shape, and location corresponding to the inner surface of tubes 36. The inside diameter size of tubes 36 is selected to attenuate the microwaves introduced through opening 20 and specifically acts as a choke to contain the microwaves within the cavity 12 formed by bore 18, tubes 22, and plates 30 while allowing access by material therein and specifically allowing the material to flow in and out of tubes 22 and/or bore 18. Each end assembly 28 is preferably 23 inches (58 cm) long. The inner surfaces of tubes 36 are preferably painted with carbon black paint to within approximately 8 inches (20 cm) of plates 30 to absorb low level microwave radiation to enhance the choke performance of end assemblies 28. The maximum overall length of the cavity formed by sections 14 and 16 with end walls 30 retracted is approximately 41.25 inches (105 cm).

A subframe 38 is provided to support cavity 12. In particular, subframe 38 includes a base 40 of any suitable construction and elongated in the axial direction. First and second cavity supports 42 upstand from base 40. Cavity 12 is secured between supports 42 at adjustable, fixed, rotatable positions about the axis of bore 18 and tubes 22. In the most preferred form, mounts 44 are provided having upper edges for abutment with the outer, lower surfaces of end sections 16, lower edges for abutment with supports 42, and outer surfaces for abutment with the axially, inner surfaces of the axially outer flanges 24 of end sections 16. Flanges 24 are adjustably secured to mounts 44 such as by bolts 46 extending through the axially extending apertures formed in flanges 24 and also in mounts 44. The apertures in mounts 44 are arcuate shaped in the most preferred form concentric to the axis of bore 18 and tubes 22 to allow rotation of end sections 16 and cavity 12 relative to mounts 44. First and second pairs of L-shaped brackets 47 are provided on opposite radial sides of each end section 16. Each pair of brackets 47 are located on opposite axial sides of and secured to mounts 44 such as by bolts 50. The other legs of brackets 47 are suitably secured to supports 42 such as by bolts as shown. It should be noted that the circumferential spacing of the apertures in flanges 24 and the circumferential length of the apertures in mounts 44 should allow transition section 14 to be adjustably secured to subframe 38 with waveguide opening 20 positioned at any desired circumferential position around the axis of bore 18 and tubes 22, with waveguide opening 20 shown at the 12 o'clock or pure vertical position in the drawings. Cradles 48 are provided in the preferred form including upper edges for abutment with the lower periphery of the axially inner flanges 24 of end sections 16 which are secured to transition section 14, with cradles 48 supporting cavity 12 intermediate its ends.

Suitable provisions are made for adjustably, axially positioning end assemblies 28 in cavity 12. In the preferred form, a carrier 52 is provided for each end assembly 28 including an elongated member 54 extending axially between and secured to inner and outer radially extending plates 56 and 58. The upper surface of member 54 abuts with the lower, outer surface of tubes 36. Carrier 52 is removably secured to end assembly 28 by any suitable means. In the preferred form, bolts 60 extend through apertures formed in plates 56 and are threaded into plates 30 of end assemblies 28. Also, clamping bands 62 extend around the outer surface of tubes 36 and members 54 at axially spaced locations.

First and second slides 64 are suitably mounted to base 40 such as by linear bearings sliding on rails as shown at fixed rotational positions relative to cavity 12 but for movement in a direction parallel to the axis of bore 18 and tubes 22. Suitable provisions such as linear actuators 66 mounted between base 40 and slides 64 reciprocate slides 64 relative to base 40. Suitable provisions such as linear displacement transducers can be provided to sense the axial position of slides 64 relative to a reference point on base 40, such as the axial center of cavity 12. A bracket 68 upstands from each slide 64. Brackets 68 are adjustably secured to plates 58 such as by bolts 70 extending through axially extending apertures formed in brackets 68 and threaded into plates 58. The apertures in brackets 68 are arcuate shaped in the most preferred form concentric to the axis of tubes 22 and bore i 8 to allow relative rotation of end assemblies 28 relative to brackets 68 and thus for holding plates 30 and end assemblies 28 inside of tubes 22 at differing, fixed, rotated positions.

Applicator 10 according to the preferred teachings of the present invention further includes suitable provisions for continuously moving material through cavity 12. In the preferred form, the material is moved through cavity 12 within a dielectric or generally microwave transparent enclosure shown in the most preferred form as a tube assembly 72 which passes through end assemblies 28 and cavity 12 and specifically through bore 18 and tubes 22 and 36. In the preferred form, assembly 72 includes an elongated tube 74 formed of low dielectric loss factor material such as fiberglass made from low lead glass fiber and a silicon resin. However, tube 74 could be formed of other materials having high temperature resistance, structural strength, and low dielectric loss, such as but not limited to alumina, polyetheretherketone, and KEVLAR aramid fiber material. A plurality of inserts 76 are placed within tube 74 in an axially abutting relation to provide a food grade surface that resists burning, with inserts 76 formed from Teflon in the most preferred form. It can then be appreciated that tube 74 provides the structural support for inserts 76, with tube 74 and inserts 76 being able to withstand high temperatures.

Tube assembly 72 is rotatably supported within cavity 12 and relative to the bores of plates 30 and tubes 36 of end assembly 28. In the preferred form, a collar 78 carrying a plurality of rollers 80 is secured to the outer axial ends of tubes 36 axially outward of plates 58 and brackets 68. Rollers 80 roll upon the outer surface of tube 74 and allow slideable, axial movement of rollers 80 along the outer surface of tube 74.

Applicator 10 further includes an input assembly 82 for feeding material into tube assembly 72, with input assembly 82 being suitably mounted to subframe 38 in the preferred form. In the most preferred form where applicator 10 is utilized to heat solid particulate material, input assembly 82 generally includes a cylindrical auger housing 84 extending from a hopper 86. A rotary valve 88 is attached to the top of hopper 86 for allowing entry of material into hopper 86 but generally preventing the escape of air therefrom. An auger 90 is rotatably mounted in auger housing 84. Auger 90 is formed from a spiral flight 91 preferably formed of nonmetallic material and most preferably of a polymeric material such as DELRIN acetyl resin and extending axially along a shaft. In the preferred form, a plurality of holes 92 of a size considerably smaller than the radius of the spiral flight 91 extends through the spiral flight 91 spaced from the outer edge thereof and adjacent the shaft of auger 90, with the material being conveyed by auger 90 in housing 84 generally located radially below holes 92. In the preferred form, an air plenum or manifold 94 is in fluid communication with hopper 86 such as through a screen 93 formed in the side of hopper 86 for introducing air into input assembly 82. It can then be appreciated that holes 92 allow the air to pass axially through auger housing 84 without requiring the air flow to spiral around the shaft of auger 90 which may result in entrainment of the material with the air flow. Suitable provisions are made for auger 90 and rotary valve 88 to eliminate sliding metal-to-metal contact for reducing the chances of generating fine metal shavings in the material, which could cause arcing inside cavity 12. Rotary valve 88 and auger 90 are driven at variable speeds by any suitable means such as by a motor 96 including a suitable drive, with motor 96 driving both rotary valve 88 and auger 90 in the most preferred form.

In the most preferred form, the inner surface of inserts 76 of tube assembly 72 has a size and shape generally equal to and for slideable and rotatable receipt on the outer surface of auger housing 84. Suitable pneumatic seals can be provided between assembly 72 and housing 84 to prevent the escape of air therebetween. Subframe 38 can include an annular collar 95 of a diametric size larger than tube assembly 72, with suitable rollers 97 being provided mounted to collar 95 and for rolling contact on the outside surface of tube assembly 72.

Movement of product through tube assembly 72 in the most preferred form is controlled by rotation of tube assembly 72. In the preferred form, a motor 98 is provided including a suitable drive for tube assembly 72. In the most preferred form, a drive element in the form of a sheave 99 is secured to tube 74 at an axial position on auger housing 84 and receives a belt extending around a speed reducer provided on motor 98. Movement of material through tube assembly 72 can be enhanced by using an auger formed of dielectric material extending inside of tube assembly 72 or by installing screw flights on the inside surface of tube assembly 72. However, it should be understood that the material could be moved through cavity 12 by other methods depending upon the particular material with or without tube assembly 72 or an equivalent conveying means. Such methods could include but are not limited to by pumping pumpable material through tube assembly 72 which could be stationary, by conveyors, by belts, or by similar means.

In addition, cavity 12 and tube assembly 72 could be placed at an incline to assist movement of material through tube assembly 72. In the preferred form, subframe 38 is pivotally mounted to a main frame 100 about a horizontal axis 101 extending generally perpendicular to cavity 12 and tube assembly 72. In the preferred form, cavity 12 and tube assembly 72 can be tilted at an angle in the range of 0° to 15° from the horizontal, with the preferred angle for puffing and toasting solid particulate material being in the range of 4° to 6° from the horizontal. Suitable provisions such as shown can be provided for holding subframe 38 and thus cavity 12 and tube assembly 72 at the desired angle.

Applicator 10 further includes an output assembly 102 for receiving material from tube assembly 72, with output assembly 102 being vertically and horizontally adjustably mounted independent of subframe 38 in the preferred form. In the most preferred form where applicator 10 is utilized to heat solid particulate material, output assembly 102 generally includes a receiver box 104 into which the outlet end of tube assembly 72 extends in a pneumatically sealed relation. A rotary valve 106 is attached to the bottom of box 104 for allowing exit of material from box 104 but generally preventing the escape of air therefrom. An air plenum or manifold 108 is in communication with box 104 to allow the exit of air from box 104 and towards suitable dust separators and air cleaners and scrubbers before its release to the environment.

Microwave energy from a suitable microwave generator is introduced into cavity 12 between the elongated casing and end assemblies 28 in a manner to couple the microwave power to cavity 12. Specifically, applicator 10 according to the preferred teachings of the present invention utilizes waveguide 110 secured to opening 20 of transition section 14 to provide the power required for a large industrial continuous heating system. To obtain efficient power transfer to cavity 12, a variable, impedance matching device 112 is provided associated with waveguide 110. In the preferred form, device 112 utilized was a manual, three stub tuner. However, it can be appreciated that impedance matching device 112 could be, but is not limited to, any multiple stub tuner, four junction hybrid with movable end assemblies attached to decoupled ports, a magic tee with movable end assemblies in the arms, a short-slot coupler with two movable end assemblies, or an electromagnetic tuner. Additionally, impedance matching device 112 could possibly be a movable short attached to cavity 12 directly opposite opening 20 to cavity 12. It should also be noted that impedance matching device 112 could be automated to allow continuous impedance adjustment during operation.

In the preferred form, the microwave generator utilized is of a commercially available, variable power, 75 kW, 915 MHz type. Although applicator 10 is also well suited for use with the other common industrial microwave generator generating microwaves at a frequency of 2450 MHz the use of 915 MHz frequency generators does provide advantages in large scale, continuous, industrial processing. First, the largest currently commercially available 2450 MHz magnetron is about 15 kW. Further, the diameter of tube assembly 72 is limited by the diameter of tubes 36 required to resulting in choking. The choke diameter is determined by the wavelength of the microwaves, which in turn depends on frequency. As the frequency decreases, the possible diameter of tubes 36 increases and thus allows the use of an increased diameter for tube assembly 72. Larger diameter tube assemblies 72 allow for processing at higher flow rates and processing of materials with larger piece sizes and lower bulk densities.

Figure 5:
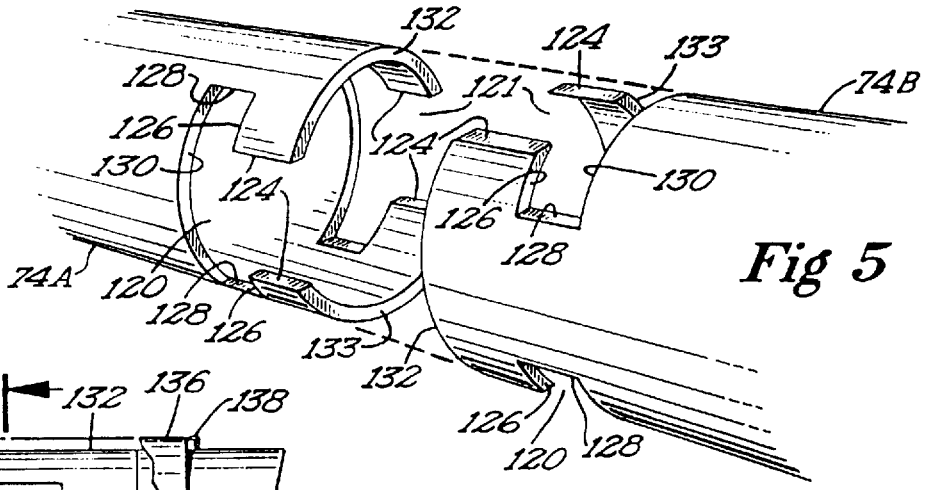
FIG. 5 shows a partial, exploded, perspective view of a tube of the tube assembly of the tunable cavity microwave applicator of FIG. 1.
Figure 6:
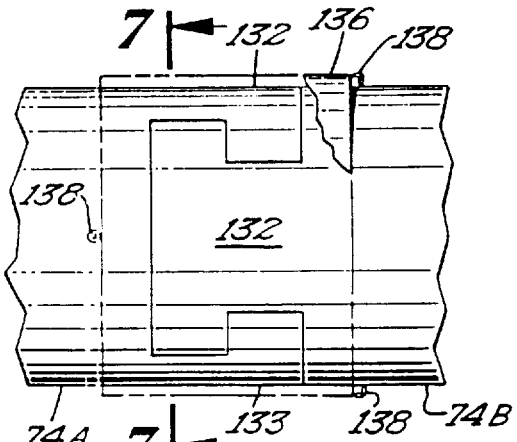
FIG. 6 shows a partial side view of the tube of FIG. 5, with portions broken away and shown in phantom to show constructional details.
Figure 7:
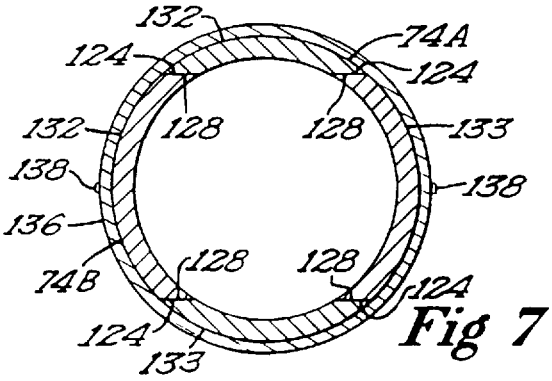
FIG. 7 shows a cross-sectional view of the tube of FIG. 5 according to section line 7—7 of FIG. 6.

Tube 74 of tube assembly 72 according to the preferred teachings of the present invention is formed of three tubular sections as the material from which tube 74 is formed is not commercially available in lengths desired for tube assembly 72. Particularly, as best seen in FIGS. 5–7, the ends of tubular sections 74A and 74B which are interconnected together to form tube 74 generally include first and second, diametrically opposite, key-hole-shaped slots 120 and 121 extending axially from the free ends thereof, with slots 120 and 121 in the most preferred form being T-shaped. In particular, each slot 120 and 121 includes first and second surfaces 124 extending generally axially from the free ends of tubular sections 74A and 74B in a circumferentially spaced manner. First and second surfaces 124 terminate, respectively, in third and fourth surfaces 126 extending in opposite directions parallel to and axially spaced inward of the free ends of sections 74A and 74B and generally perpendicular to the axis of tube 74. Third and fourth surfaces 126 terminate, respectively, in fifth and sixth surfaces 128 extending axially inward from surfaces 126 and axially away from and relative to the free ends of tubular sections 74A and 74B in a circumferentially spaced manner greater than the circumferential spacing of surfaces 124. Fifth and sixth surfaces 128 terminate in a seventh surface 130 extending between surfaces 128 parallel to and axially spaced inward of surfaces 126 and the free ends of sections 74A and 74B and generally perpendicular to the axis of tube 74. It should then be noted that slots 120 and 121 form first and second, diametrically opposite, T-shaped extensions 132 and 133 extending axially from surfaces 130 to the free ends of sections 74A and 74B.

According to the preferred teachings of the present invention, surfaces 124 and 128 of extensions 132 and 133 of section 74A are beveled radially inward with the circumferential length of extensions 132 and 133 between surfaces 124 and 128 being greater at the outer surface than at the inner surface of tube 74. In a complementary manner, surfaces 124 and 128 of extensions 132 and 133 of section 74B are beveled radially outward with the circumferential length of extensions 132 and 133 between surfaces 124 and 128 being greater at the inner surface than at the outer surface of tube 74. The angles of surfaces 124 and 128 of sections 74A and 74B are generally complementary to each other. Particularly, in the preferred form, surfaces 124 and 128 of section 74A are beveled at an angle in the order of 45° from a radial line at its intersection with the outer surface of tube 74 while surfaces 124 and 128 of section 74B are beveled at an angle in the order of 45° from a radial line at its intersection with the inner surface of tube 74. It can then be appreciated that by suitable manipulation, extensions 132 and 133 of section 74A can be inserted into slots 120 and 121 of section 74B and extensions 132 and 133 of section 74B can be inserted into slots 120 and 121 of section 74A with surfaces 124 of section 74A fleshly abutting with surfaces 128 of section 74B, surfaces 124 of section 74B fleshly abutting with surfaces 128 of section 74A, surfaces 126 of sections 74A and 74B flushly abutting, surface 130 of section 74A flushly abutting with the free end of section 74B and surface 130 of section 74B flushly abutting with the free end of section 74A. It should then be noted that the inner and outer surfaces of sections 74A and 74B are contiguous when sections 74A and 74B are interconnected together. In the most preferred form, both end sections forming tube 74 are of identical construction such as the construction of section 74A and the center section includes the same end interconnection on both axial ends such as the construction of section 74B.

It should then be appreciated that when interconnected together, separation of sections 74A and 74B cannot occur as the result of relative axial or rotational movement between sections 74A and 74B but requires relative transverse movement in one plane only. To prevent such relative transverse movement, a collar 136 formed of dielectric material is provided having an inner surface corresponding to and for axial and rotatable slideable receipt on the outer surface of tube 74. Suitable provisions can be made for preventing sliding of collar 136 on tube 74 such as pins 138 formed of dielectric material and pressed into sections 74A and 74B generally radially inward and abutting the opposite axial ends of collar 136. In the most preferred form, pins 138 are formed of polyetheretherketone.

Generally, the operation of applicator 10 of the most preferred form can now be set forth and appreciated. Specifically, in the most preferred form, subframe 38 and thus tube assembly 72 are fixed generally horizontally and in the preferred form at a slight angle to the horizontal. The material to be microwave heated is introduced by input assembly 82 into tube assembly 72. Particularly, the material is introduced by rotary valve 88 and falls by gravitational force into hopper 86 where it is conveyed through housing 84 by rotation of auger 90 into tube assembly 72. Simultaneously, air is introduced into hopper 86 by air manifold 94 where it flows through housing 86 through holes 92 as set forth hereinbefore. Rotary valve 88 allows entry of the material into hopper 86 while generally preventing escape of air from hopper 86. Due to the rotation and incline of tube assembly 72, the material flows in tube assembly 72 from input assembly 82 and moves through cavity 12 towards output assembly 102. While moving through cavity 12, the material inside of tube assembly 72 is subjected to microwaves entering cavity 12 from waveguide 110. After passing through cavity 12, the material continues to flow through tube assembly 72 and falls by gravitational force into box 104 and rotary valve 106. Rotary valve 106 allows exit of the material from box 104 while generally preventing escape of air from box 104. The air instead passes to and through manifold 108 for suitable processing before release into the environment.

Now that the basic construction and physical operation of applicator 10 according to the preferred teachings of the present invention have been set forth, some of the advantages of applicator 10 and of the teachings of the present invention can be highlighted. It should be noted that residence time of the material in cavity 10 depends upon feed rate and bed mass. According to the preferred teachings of the present invention with tube assembly 72 in a nearly horizontal position, the size of the material bed can be changed independently of the feed rate, with the material bed having a cross-sectional area considerably less than the cross-sectional area of tube assembly 72. Further, in the preferred form with tube assembly 72 being rotatable, the material bed size can be decreased by increasing the tube rotation speed and increased by decreasing the tube rotation speed. The angle of incline of tube assembly 72 in the most preferred form can also be adjusted to control the material bed size and corresponding residence time. Therefore, the heating rate in applicator 10 can be increased by minimizing the bed size and maximizing the feedrate. High heating rates are especially important for puffing. Some materials require very high heating rates to effect adequate expansion for desirable products.

It should also be noted that during heating of the material, moisture is driven out of the material and is generally desirably removed from the material surface by evaporation. Additionally, since microwaves tend to force moisture to the surface faster than it can naturally evaporate, the surfaces of relatively high water content microwave heated materials become very moist, even wet. The excess moisture at the surface inhibits the browning reactions required for toasting. In order to get good toasting in a microwave applicator, the mass transfer rate of water at the material surface must be increased to keep the surface dry. U.S. Pat. No. 4,714,812 discloses a system where moisture removal from the feed tube is effected in a unit after the power cavity. Although this approach may not present problems for the drying of grains, it does limit the utility to nonsticky materials with limited drying rates. Particularly in the case of puffing high moisture, high sugar cereal half product, the material could plug up the feed tube. Once this happens, the material plugged in the cavity would heat until it burned, stopping production and potentially damaging the equipment. Similarly, utilizing this approach for surface toasting of the material would be limited. Applicator 10 according to the preferred teachings of the present invention provides concurrent heating and moisture removal to improve surface toasting and avoid material clumping problems and in particular the air is concurrent with the material. Air is introduced into auger housing 84 with the material. Since tube assembly 72 is pneumatically sealed, the air is forced to travel down tube assembly 72 with the material. The air may also be heated to about 250° F. (120° C.) to increase the surface drying rate and increase the moisture carrying capacity of the air. The air temperature is maintained high enough to prevent condensation on the walls of tube assembly 72 and receiver box 104 in the most preferred form.

In the most preferred form, cavity 12 is tunable and is designed for continuous processing. Although U.S. Pat. No. 4,714,812 discloses a tunable resonant cavity also designed for continuous processing as set forth hereinbefore, cavity 12 according to the preferred teachings of the present invention represents a significant improvement thereover. In particular, cavity 12 according to the preferred teachings of the present invention utilizes two movable end assemblies 28 rather than one as disclosed in U.S. Pat. No. 4,714,812 such that not only is the axial length of cavity 12 adjustable according to material conditions, but also the distance from the centerline of waveguide opening 20 to each end assembly 28 is adjustable. Although one approach is to set the axial length of the cavity to an integral multiple of ¼ of the effective wavelength, it may also be desirable to "over couple" microwave energy to the cavity such that the effective band width is increased. This will accommodate changes in the resonant frequency of the load due to temperature and moisture changes, for example.

Also, it is disclosed in U.S. Pat. No. 4,714,812 that the movable piston thereof is movable over a 2 inch (5 cm) length of travel, or perhaps somewhat more or in other words less than ⅜ wavelength for the empty cavity. Further, it is disclosed in U.S. Pat. No. 4,714,812 that when the movable piston thereof is in its lower position, the cavity is on the order of 6 inches (15 cm) or in other words approximately 1 wavelength long. Therefore, the effective length of the cavity is approximately 13/16 to 19/16 wavelengths long. However, end assemblies 28 according to the preferred teachings of the present invention each have a length of travel of about ⅝ wavelength.

Using the approach of seeking critical coupling (in contrast to "overcoupling"), the two end assemblies 28 with greater length of travel (in terms of waveguide wavelength) give greater flexibility in controlling the heating rate experienced by the material. As examples, end assemblies 28 could both be positioned generally at their axially inner positions which is generally equal to ¼ wavelength when cavity 12 is empty from the center of opening 20 in the most preferred form. With end assemblies 28 so positioned, cavity 12 has an effective length between end assemblies 28 generally equal to transition section 14 which is ½ wavelength. In this instance, the material experiences a single very large electric field at the center of cavity 12. This configuration might be desirable to puff a material without toasting. Likewise, the upstream end assembly 28 could be positioned generally at an axially outer position and the downstream end assembly 28 could be positioned generally at its axially inner position such that cavity 12 has an effective length generally equal to transition section 14 plus the upstream end section 16 which is 1 wavelength. In this instance, two areas of high field strength are established. The first, upstream of waveguide opening 20, will be weaker than the second, at the centerline of waveguide opening 20. This configuration can be used when preheating the material before puffing or toasting is desirable. Similarly, the upstream end assembly 28 could be positioned generally at an axially inner position and the downstream end assembly 28 could be positioned generally at its axially outer position such that cavity 12 has an effective length generally equal to transition section 14 plus the downstream end section 16 which is 1 wavelength. Again, two areas of high field strength are established but, in this instance, the first area of high field strength will now be greater than the second. This configuration might be used to puff the material and then toast it. Further, end assemblies 28 could both be positioned generally at their axially outer positions such that cavity 12 has an effective length generally equal to transition section 14 plus both end sections 16 which is 1½ wavelengths. In this instance, three areas of high field strength are established, the first ½ wavelength upstream of waveguide opening 20, the second at waveguide opening 20, and the third ½ wavelength downstream from the waveguide opening. The second area of high field strength would be greater than the first and third, which will both be comparable in magnitude. This configuration could be used for preheating, puffing, and toasting.

Changing the length of cavity 12 by multiples of ¼ wavelength also enables controls of the material residence time independent of the material feedrate and bed height in cavity 12. The average residence time in cavity 12 is the total bed mass in cavity 12 divided by the material feedrate. Therefore, the residence time can be changed by changing the feedrate or the bed mass in cavity 12. The feedrate is already constrained by the specific energy input required by the material and the generator power capability. The bed mass can be changed in one of two ways. Either the bed height can be changed or the length of cavity 12 can be changed. The bed height must be above some critical level to couple the microwaves with the bed. Therefore, having the capability to change the length of cavity 12 (for example, by incrementing it in multiples of a quarter wave length) provides added flexibility for controlling the material residence time.

The Q values (and by that the frequency bandwidth) of a cavity with a very small coupling factor is determined by the cavity only, and is called the unloaded Q value "$Q_O$". Under critical coupling the loaded Q value "$Q_L$"(as measured from the transmission line) becomes $\frac{1}{2}Q_O$, which is favorable, since frequency bandwidth is inversely proportional to $Q_L$.

Figure 8:
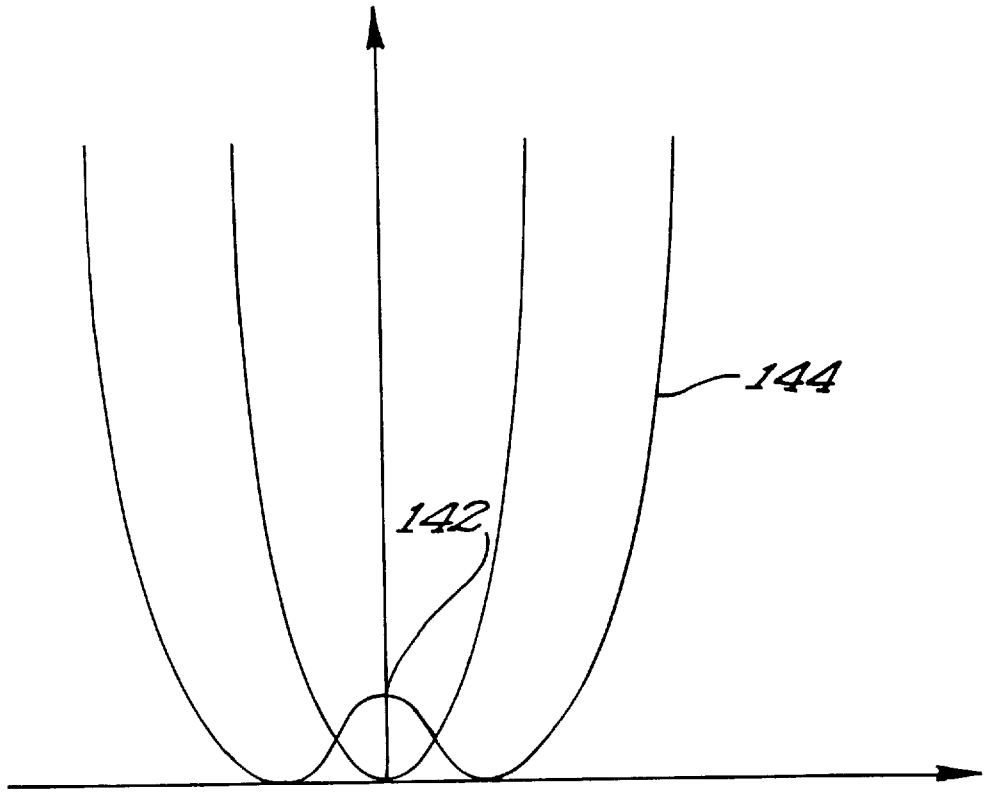
FIG. 8 shows idealized plots of Standing Wave Ratio as a function of frequency, with the coupling factor as a parameter.

Referring now most particularly to FIG. 8, if the coupling factor is increased further (i.e. to an "overcoupled" condition), there will no longer be impedance matching at resonance, but instead at two frequencies, each located on opposite sides of the resonant frequency, as indicated by curve 144. If a band limit corresponding to 5% power loss by reflection back towards the generator (with a circulator used to isolate the magnetron) is used as criterion for the practical bandwidth for good system operation, the corresponding standing wave ratio (SWR) becomes 1.58 at resonance as indicated at point 142 in FIG. 8. If the frequency bandwidth for zero coupling factor is used as a reference, it becomes twice as large at critical coupling and about 3 times as large at the "sub-optimum" coupling factor 1.58 (this becomes the same as the SWR at resonance). Thus it may be seen that a decrease of the sensitivity to load parameter variations is achieved with the technique of intentionally "overcoupling" to accommodate such load parameter variations.

When a load heats up, its relative real permittivity $\epsilon''$ decreases due to the dielectric behavior of water with temperature, since water is assumed to exist in the load material. Drying-out will also lower $\epsilon''$. This means that the resonant frequency will increase. If the cavity tuning is made such that the operating frequency is near the higher frequency matching point (the right minimum in FIG. 8), the advantage of maintaining a low reflection into the transmission line is maintained during a larger part of the dynamic process than if any other working point is selected. This will increase the efficiency of the process, and contribute to the predictability of system behavior during the dynamic situation where parts of the load are not at the same temperature, as when the instrumentation is connected and the system calibration is made.

Referring now again to FIGS. 1–7, applicator 10 is also advantageous in aligning the material bed with the microwave field in cavity 12 to improve heating uniformity of the material. In particular, due to the rotation of tube assembly 72, the material bed will not have a horizontal orientation in tube assembly 72 but rather will tend to ride up the inner surface of tube assembly 72 in the direction of rotation or in other words will have an angled orientation within tube assembly 72. This angle will depend upon the material itself, the size of the bed, and the speed of rotation of tube assembly 72. It should then be noted that due to the adjustable securement of cavity 12 to mounts 44, opening 20 and waveguide 110 can be orientated at fixed circumferential positions about the axis of tube assembly 72 such that the high field strength area of cavity 12 is essentially parallel to the material bed in tube assembly 72. In the preferred form, opening 20 and waveguide 110 will typically be at an angle in the order of plus or minus 30° from a 12 o'clock, vertical condition.

Additionally, the axes of tubes 36 and tube assembly 72 are radially offset from the axis of bore 18 and tubes 22 and in particular is offset such that the axial mass centerline of the material bed in tube assembly 72 is as close to the axis of bore 18 and tubes 22 as possible. Additionally, it should then be noted that due to the adjustable securement of end assemblies 28 to brackets 68, tube assembly 72 can be adjustably positioned inside of bore 18 and tubes 22 to superimpose the cross-sectional area of the material bed to be located at the cross-sectional area of cavity 12 having the highest microwave field strength.

It should be noted that the microwave modes generally supported in loaded cavity 12 may, in practice, be hybrid modes (in contrast to simple TE or TM modes). However, standard design procedures for sizing hollow cavities 12 to excite a particular TE or TM mode can be used for applicator 10. In the preferred embodiment, applicator 10 is designed to heat solid particulate material, for which the bed cross section is generally rectangular, or oblong. Cavity 12 was designed for the $TE_{11n}$ mode, which has an approximately rectangular area of highest field intensity in the middle of cavity 12. Since the cross-sectional areas of the material bed and highest field intensity are both similar in shape, they can be superimposed on each other to effect uniform heating. The internal cavity diameter for the $TE_{11n}$ mode is about 9 inches (22.9 cm) at 915 MHz and about 3.4 inches (8.6 cm) at 2450 MHz.

If applicator 10 were designed according to the teachings of the present invention for processing a pumpable liquid in cylindrical tube assembly 72, the $TM_{01n}$ mode is believed to be more desirable, since cross sections of both the material stream and area of highest field strength are both circular. In this case, the internal cavity diameter would be about 11.8 inches (30 cm) at 915 MHz and 4.4 inches (11 cm) at 2450 MHz, and the orientation of the feed structure will be rotated 90 degrees. Different mode characteristics are achievable for various uses by choosing an appropriate cross-sectional shape for cavity 12, and by appropriately sizing the cavity cross-sectional dimensions and feed opening size, location and orientation.

Cavity 12 of the most preferred form formed of sections 14 and 16 and tube 74 of the most preferred form formed of sections 74A and 74B are modular in form and advantageous. Specifically, easy modification of cavity 12 can be made by modification of the desired section 14 and 16 and particularly transition section 14. As an example, if it was desired to increase the maximum power to cavity 12, two waveguide openings 20 could be provided in transition section 14 at an angle of 90° to each other, with the outputs of two generators being fed into cavity 12 without cross coupling between the generators. Likewise, modular components allow replacement of only those components which are desired rather than the whole assembly (such as replacement of sections 74A and/or 74B in the event of overheating or the like as opposed to replacement of the whole tube 74).

Figure 9:
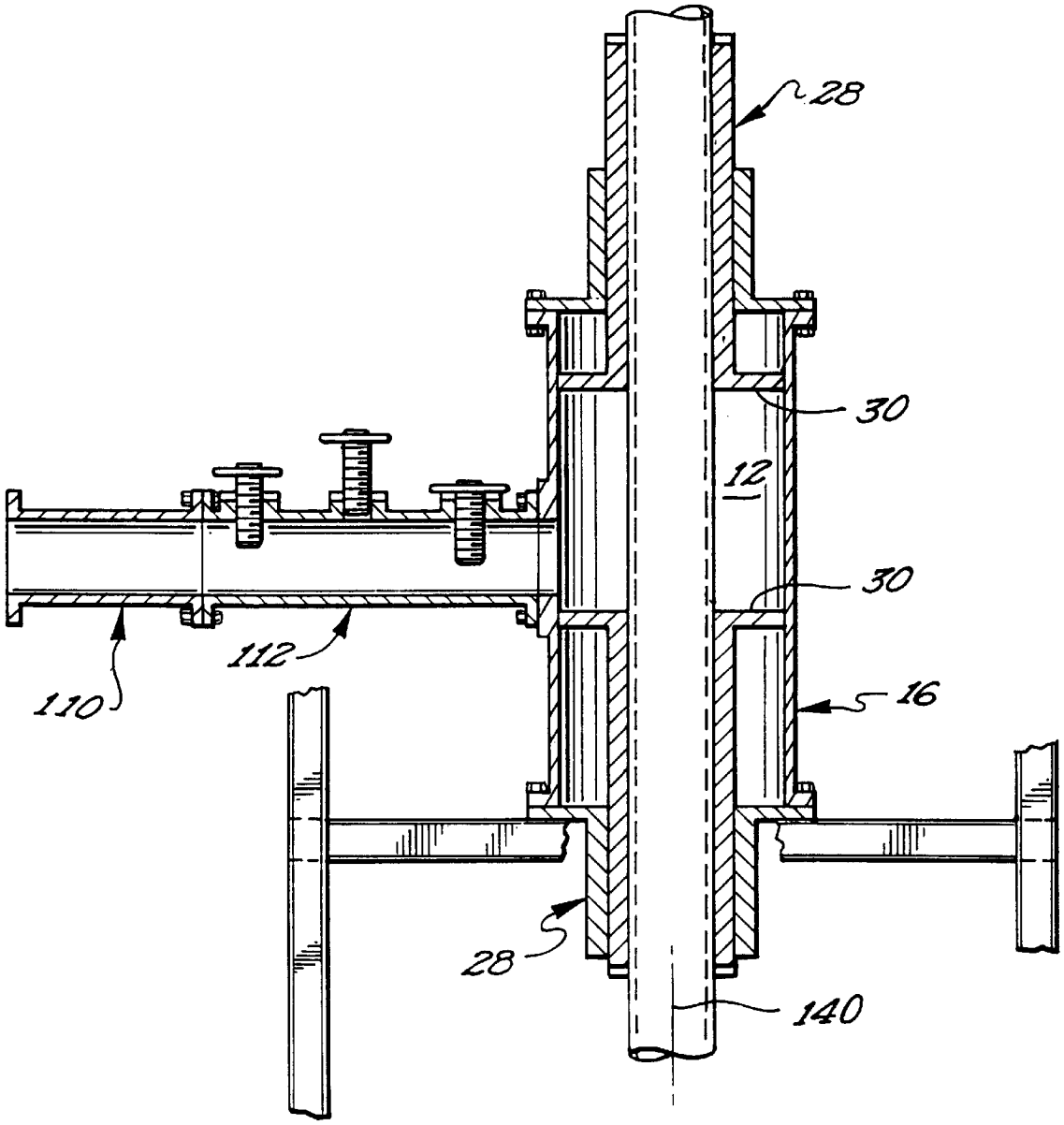
FIG. 9 shows a simplified elevation view in section of an alternative embodiment for the microwave cavity and feed structure of the present invention.

Referring now also to FIG. 9, the feed structure includes a WR-975 conventional wave guide 110 which has internal dimensions of 4⅞" by 9¾" in cross section. The feed structure also includes an impedance matching device 112, which may be a conventional three stub or four or five stub or other conventional impedance matching devices may be used and still be within the scope and spirit of the present invention. An alternative impedance matching device is a high-power auto tuner assembly available from RF Technologies Corporation of 238 Goddard Road, Lewiston, Me 04240. In FIG. 9, one end wall 30 is positioned in its inwardmost position and the other end wall 30 is positioned approximately ⅔ retracted from the inwardmost position. In addition, it is to be noted that in FIG. 9 the long axis of feed port 20 is parallel to the cylindrical axis 140 of the cavity 12.

Figure 10:
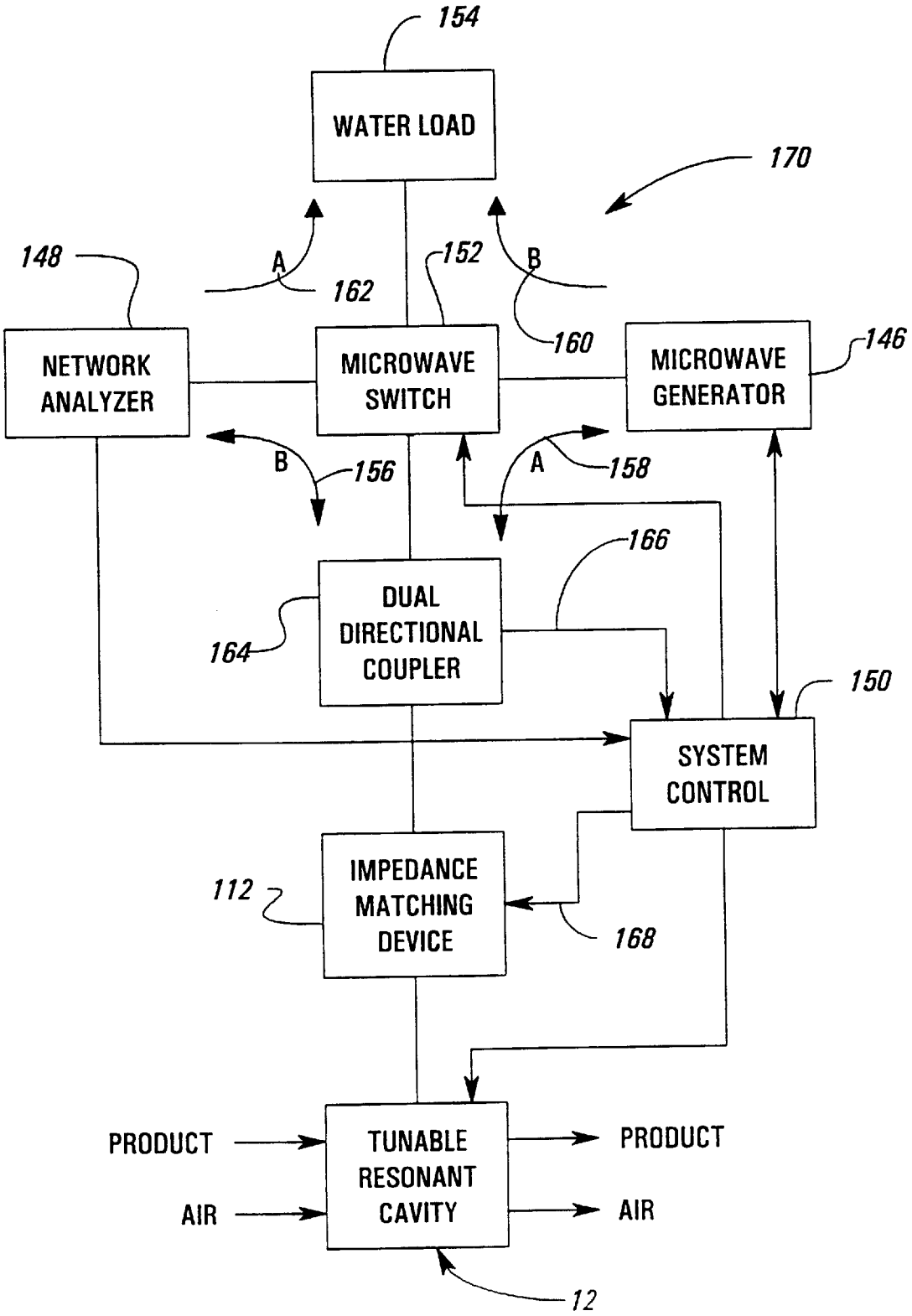
FIG. 10 shows a simplified block diagram of a control system useful in the practice of the present invention.

Referring now most particularly to FIG. 10, a block diagram of the microwave related components useful in the practice of the present invention may be seen. The microwave generator 146 is preferably a commercially available, variable power, 75 kw 915 Mhz microwave generator. It is to be understood that generator 146 preferably is a self-contained unit having a power supply, magnetron, and all controls necessary to operate the magnetron and vary the power level. A network analyzer 148 is preferably a commercially available unit that generates a precisely controlled, low-power, variable frequency microwave signal and measures the reflected signal back into the network analyzer. The network analyzer 148 measures both the phase and amplitude of the forward and reflected power over a broad range of frequency. Using an appropriate measure of coupling such as VSWR, with respect to frequency using the network analyzer, it can be determined whether the cavity is properly adjusted for resonance. The rough tuning procedure includes passing material through the cavity at the desired conditions, adjusting the end assemblies 28 to desired positions and then adjusting the impedance matching device 112 to minimize reflection at the operating frequency. Such steps can be performed manually or under automated control such as is easily achievable with a programmable controller or computer operating as the system control 150. (Alternatively, system control 150 may be manual.) A microwave switch 152 is a four-port wave guide switch. The switch 152 directs microwave energy to the cavity 12 from either the generator 146 or the network analyzer 148, but only one at a time. The source (146 or 148) not directed to the cavity 12 is directed into a water load 154. Such an arrangement allows generator 146 to be operated at full power for calibration and maintenance without changing wave guide connections. Arrow 156-162 indicate power flow directions. Arrows 156 and 158 are double headed indicating that power reflected from the cavity is also directed back to the generator or network analyzer depending upon the position of switch 152. In position A, microwave switch 152 has the power flow paths indicated by arrows 158 and 162 operative with the network analyzer connected via switch 152 to the water load 154 and the microwave generator 146 connected to a dual directional coupler 164, impedance matching device 112, and cavity 12. With switch 152 in position B, network analyzer 148 is coupled to cavity 12 as indicated by arrow 156 and the microwave generator 146 is coupled to the water load 154 as indicated by arrow 160.

The dual directional coupler 164 sends out two low-power microwave signals, one proportional to the forward power to the cavity 12 and one proportional to the reflected power from the cavity 12. Each signal is transmitted via its own coaxial line (collectively indicated schematically by line 166). Impedance matching device 112 may be controlled via line 168 by the system control 150 to automatically change impedance as desired while operating.

System control 150 may be a manual or automatic control and preferably includes a display of forward power, reflected power, end wall positions for the cavity, barrel speed, auger speed, and outlet rotary valve speed. Controls or inputs are preferably available to an operator to set generator power, end assembly position for each end of the microwave cavity, barrel speed, auger speed, and outlet rotary valve speed. It is to be understood that the product feed rate is set remotely at the product feeder or input assembly 82.

During operation, system control 150 adjusts the end assembly positions to minimize reflected power from cavity 12. This step may be characterized as a "fine tuning" adjustment. Generator power may be changed to vary the product heating rate and temperature rise. It has been found preferable not to change feed rate, barrel speed, auger speed, or outlet rotary valve speed during operation because these adjustments will change the size of the bed of material being processed and thus change the "rough tuning" required for resonance in cavity 12.

A more detailed description of the process of adjusting or tuning the microwave system 170 shown in FIG. 10 is as follows.

1. Put material to be processed in cavity to establish steady-state loaded condition.

2. Preset inlet end wall to approximately 12 inches and the outlet end wall approximately 5 inches, each as measured from the centerline of the feed port. (Other positions may be found more suitable for applications not using a TE mode.)

3. Adjust impedance matching device 112 with the microwave switch 152 in position B to get as deep a peak as possible (i.e., at or near minimum VSWR) at the operating frequency, along with broadening the bandwidth surrounding the operating frequency as desired (to accomodate parameter changes in the material to be processed) by overcoupling the microwave energy to the cavity.

4. Switch 152 is set to position A and the forward and reflected power as indicated by the dual directional coupler 164 are measured and one or both end assemblies 28 are adjusted to minimize reflected power during operation.

5. If the minimum reflected power is greater than 5% of the forward power, repeat steps 2–4 using other, empirically determined initial positions for the end walls. The adjustment procedure may be stopped when the reflected power is less than about 5% (preferably less than 2%) of the forward power.

being the distance from the inside wall of the wave guide to the end of the respective stub and with the tuner stubs A, B, and C located respectively 9.14, 15.69, and 21.31 inches from the cavity axis 140 to the respective stub center line for Examples 1 and 2 and 10.50, 16.25, and 21.88 inches from the cavity axis 140 to the respective stub center lines for Example 3. The inlet and outlet end wall dimensions given in Table A are from the interior surface of the end wall to the centerline of the feed port.

It is also to be understood that the air introduced with the product may be heated as desired, especially when it is desired to toast or dry the exterior of the product. In such instances, the air temperature and mass flow rate is preferably selected to be high enough to evaporate the surface moisture on the product (while it is subjected to the microwave energy) yet low enough not to unintentionally cook or transport the product.

TABLE A

| Example | Process | Product | Mode | Initial % Water | Approx. Unloaded Q Value | Coupling Factor @ Start | Estimated Frequency Bandwidth |
|---|---|---|---|---|---|---|---|
| 1 | Precooking or Instantizing | Soaked Rice | TE | 26 | 250 | 2.5 | 20 |
| 2 | Puffing or Toasting | Wheat berries | TE | 10 | 180 | 1.5 | 15 |
| 3 | Heating (without drying) | Popcorn | TM | 14.5 | <15 | 1 | 40 |

| | Cavity Dimensions (inches) | | | | Tuner Stub Insertion (inches) | | |
|---|---|---|---|---|---|---|---|
| Example | Inlet End Wall | Outlet End Wall | Cavity Length | Internal Diameter | A | B | C |
| 1 | 11.6 | 5 | 16.60 | 9.00 | 2.19 | 0.97 | 1.63 |
| 2 | 11.93 | 5 | 16.93 | 9.00 | 1.50 | 2.15 | 1.45 |
| 3 | 6.91 | 6.88 | 13.78 | 12.00 | 1.79 | 1.43 | 0.67 |

| Example | Product Feed Rate (lb/min) | Barrel Angle (degrees) | Auger Speed (rpm) | Barrel Speed (rpm) | Outlet Valve Speed (rpm) | Forward Power (kw) | Reflected Power (kw) |
|---|---|---|---|---|---|---|---|
| 1 | 5 | 4 | 60 | 45 | 45 | 21.0 | 1.0 |
| 2 | 7.5 | 4 | 45 | 45 | 45 | 20.0 | 0.4 |
| 3 | 42.9 | 90 | 0 | 0 | 0 | 10.1 | 0.0 |

It has been found through experience that an initial setting of 5–6 inches from the feed port center line is desirable for the inlet end wall 30 and 11–12 inches is preferable for the outlet end wall 30 position for initial settings, unless experience dictates otherwise with a particular product to be processed.

Referring now to Table A, three examples of feed system arrangements and impedance matching tuning are presented. In examples one and two, the orientation of the long dimension of feed port 20 is parallel to the cavity cylindrical axis 140. In example three, the feed port long dimension is perpendicular to the axis 140, using an alternative embodiment (not shown, but similar to cavity 12). For all of the examples, a three-stub tuner was used as the impedance matching device 112 with the tuner stub locations as shown Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A microwave applicator comprising, in combination: a tunable cavity including an elongated casing including upstream and downstream axially outer ends; a first wall within the elongated casing adjacent the upstream axially outer end and axially movable with respect to the elongated casing; and a second wall within the elongated casing adjacent the downstream axially outer end and axially movable with respect to the elongated casing; means for introducing microwave power into the cavity between the elongated casing and the first and second walls in a manner to couple the microwave power to the tunable cavity; and means for continuously moving material through the tunable cavity for subjection to the microwave power in the tunable cavity.

2. The microwave applicator of claim 1 further comprising, in combination: means for adjustably orientating the introducing means at fixed circumferential positions about the material moving through the tunable cavity.

3. The microwave applicator of claim 1 wherein the material moves generally horizontally through the tunable cavity in a bed having a cross-sectional area; and wherein the material moves through the tunable cavity generally with the cross-sectional area of the bed superimposed on the area of highest field strength of the microwave power.

4. The microwave applicator of claim 3 wherein the continuously moving means comprises a tube assembly; and wherein the microwave applicator further comprises, in combination: means for adjustably positioning the tube assembly inside of the elongated casing.

5. The microwave applicator of claim 4 wherein the elongated casing has an inside surface of a cylindrical shape and having an axis; wherein the walls have a circular periphery of a size for slideable receipt in the inside surface; wherein the walls each includes an axial bore extending therethrough and having an axis, with the tube assembly passing through and being supported relative to the axial bores of the walls, with the axis of axial bores of the walls being offset from the axis of the inside surface of the elongated casing; and wherein the adjustably positioning means comprises means for holding the walls inside of the inside surface of the elongated casing at differing, fixed rotated positions.

6. The microwave applicator of claim 5 wherein the holding means comprises, in combination: first and second brackets at a fixed rotational position relative to the elongated casing; and means for adjustably securing the first and second walls to the first and second brackets, respectively.

7. The microwave applicator of claim 6 further comprising, in combination: first and second means for axially moving the brackets relative to the elongated casing, with axial movement of the brackets causing axial movement of the walls with respect to the elongated casing.

8. The microwave applicator of claim 1 wherein the continuously moving means adjustably positions the material moving inside of the elongated casing.

9. The microwave applicator of claim 1 further comprising, in combination: means for adjustably holding the tunable cavity at an angle of 0° to 15° to the horizontal.

10. The microwave applicator of claim 1 wherein the continuously moving means comprises a tube assembly; and wherein the microwave applicator further comprises, in combination: means for rotating the tube assembly relative to the elongated casing and the first and second walls.

11. The microwave applicator of claim 1 wherein the introducing means comprises a waveguide.

12. The microwave applicator of claim 1 wherein the continuously moving means comprises a tube assembly; and wherein the microwave applicator further comprises, in combination: an input assembly and an output assembly, with the input and output assemblies being pneumatically sealed to the tube assembly, with the input assembly including an auger housing and an auger rotatably mounted in the auger housing, with the auger including a shaft and a spiral flight extending axially along the shaft and having an outer edge, with the input assembly further including a plurality of holes of a size considerably smaller than the radius of the spiral flight extends from the shaft and located spaced from the outer edge of the spiral flight, with the auger allowing material to be conveyed in the auger housing by the spiral flight below the plurality of holes and the holes allowing air to pass axially through the auger housing without requiring the air to flow in a spiral around the shaft.

13. The microwave applicator of claim 12 further comprising, in combination: means for rotating the tube assembly relative to the elongated casing, the first and second walls, and the auger housing, with the auger housing including a cylindrical outer surface and the tube assembly including a cylindrical inner surface for slideable receipt on the outer surface of the auger housing, with the rotating means including a drive element secured to the tube assembly.

14. The microwave applicator of claim 1 wherein the continuously moving means comprises a tube assembly; and wherein the microwave applicator further comprises, in combination: first and second means carried by the first and second walls for supporting the tube assembly each comprising, in combination: a plurality of rollers; and means for mounting the rollers to the wall, with the rollers being movable axially on the tube assembly.

15. The microwave applicator of claim 14 wherein the tube assembly has a cylindrical outer surface and is rotatable relative to the elongated casing and the first and second walls, with the rollers rolling on the cylindrical outer surface of the tube assembly.

16. The microwave applicator of claim 15 wherein each of the walls include a cylindrical member attached to the wall, with the tube assembly extending through the cylindrical member and the wall; and wherein the rollers are mounted to the axial end of the cylindrical member opposite the wall.

17. The microwave applicator of claim 1 further comprising, in combination: first and second cylindrical members attached to the first and second walls, respectively, with the continuously moving means moving the material through the first and second cylindrical members, with the first cylindrical member having an axially outer end opposite the first wall, with the second cylindrical member having an axially outer end opposite the second wall; and means secured adjacent to the outer ends of the first and second cylindrical members for moving the first and second walls with respect to the elongated casing.

18. The microwave applicator of claim 17 wherein the moving means comprises, in combination: first and second brackets; means for securing the brackets to at least one of the first and second walls and the first and second cylindrical members; and means for axially moving the brackets relative to the elongated casing.

19. The microwave applicator of claim 18 wherein the securing means comprises means for adjustably securing the brackets at differing rotation positions relative to the first and second walls.

20. The microwave applicator of claim 18 wherein the axially moving means comprises first and second linear actuators.

21. The microwave applicator of claim 18 wherein the continuously moving means comprises a tube assembly; and wherein the microwave applicator further comprises, in combination: a plurality of rollers mounted adjacent the outer ends of the first and second cylindrical members for supporting the tube assembly, with the rollers being movable axially on the tube assembly.

22. The microwave applicator of claim 21 wherein the tube assembly has a cylindrical outer surface and is rotatable relative to the elongated casing and the first and second walls, with the rollers rolling on the cylindrical outer surface of the tube assembly.

23. The microwave applicator of claim 1 wherein the elongated casing further includes a transition section, an upstream end section, and a downstream end section, with the transition section located axially intermediate the end sections, with the introducing means introducing microwave power into the transition section, with the transition section having a length generally equal to ½ of the wavelength of the microwaves, with the first and second walls being axially movable in the end sections away from the transition section a length generally equal to ½ of the wavelength of the microwaves.

24. The microwave applicator of claim 23 wherein the transition section is removably secured to the end sections.

25. The microwave applicator of claim 24 wherein each of the end sections is formed of a sleeve having flanges at its axial ends, with the end sections being secured to the transition section by bolts extending through circumferential spaced holes formed in the flanges.

26. The microwave applicator of claim 25 further comprising, in combination: at least first and second mounts having arcuate shaped apertures for receiving bolts securing the flanges to the mounts for adjustably positioning the transition section at fixed circumferential positions.

27. The microwave applicator of claim 1 wherein the continuously moving means comprises a tube assembly comprising a tube comprising, in combination: at least first and second tubular sections having axial free ends, with each tubular section including first and second, diametrically opposite, generally T-shaped slots extending axially from the free ends forming and defining opposite first and second, diametrically opposite, generally T-shaped extensions, with the first extension of the first tubular section received in the first slot of the second tubular section, the first extension of the second tubular section received in the first slot of the first tubular section, the second extension of the first tubular section received in the second slot of the second tubular section, and the second extension of the second tubular section received in the second slot of the first tubular section.

28. The microwave applicator of claim 27 wherein the tube assembly further comprises, in combination: a collar having an inside surface for slideable receipt over the axial free ends of the first and second tubular sections and extending over the slots and extensions; and means for removably holding the collar against axial movement relative to the first and second tubular sections.

29. The microwave applicator of claim 27 wherein each of the generally T-shaped extensions includes first, second, third, fourth, fifth, and sixth surfaces, with the fifth and sixth surfaces extending axially inward from the free end at a circumferential spacing, with the fifth and sixth surfaces terminating, respectively, in the third and fourth surfaces extending parallel to the free end and towards each other with, the third and fourth surfaces terminating, respectively, in the first and second surfaces extending axially inward at a circumferential spacing less than the circumferential spacing of the fifth and sixth surfaces, with the first, second, fifth, and sixth surfaces of the first and second extensions of the first tubular section being beveled circumferentially inward, and with the first, second, fifth, and sixth surfaces of the first and second extensions of the second tubular section being beveled circumferentially outward for flushly abutting with the surfaces of the T-shaped extensions of the first tubular section.

30. The microwave applicator of claim 1 wherein the continuously moving means comprises means for continuously moving material through the tunable cavity in a material bed having a cross section of a generally oblong shape; and wherein the cavity with no material moving therethrough supports a $TE_{11n}$ mode therein with the introduction of microwave power.

31. The microwave applicator of claim 1 wherein the continuously moving means has circular cross sections; and wherein the cavity with no material moving therethrough supports a $TM_{01n}$ mode therein with the introduction of microwave power.

32. The microwave applicator of claim 1 wherein the continuously moving means comprises means for continuously moving material through the tunable cavity and at least one of the first and second walls.

33. The microwave applicator of claim 32 wherein the continuously moving means comprises means for continuously moving material through the tunable cavity and both of the first and second walls.

34. The microwave applicator of claim 1 wherein the continuously moving means comprises means for continuously moving material having a cross section smaller than that of the tunable cavity and at a position near the middle of the cross section of the tunable cavity.

35. The microwave applicator of claim 34 wherein the position of the cross section of the material is adjustable relative to the cross section of the tunable cavity.

36. A dielectric tube assembly for passing material continuously through a microwave applicator comprising a tube comprising, in combination: at least first and second tubular sections having axial free ends, with each tubular section including first and second, diametrically opposite, generally T-shaped slots extending axially from the free ends forming and defining opposite first and second, diametrically opposite, generally T-shaped extensions, with the first extension of the first tubular section received in the first slot of the second tubular section, the first extension of the second tubular section received in the first slot of the first tubular section, the second extension of the first tubular section received in the second slot of the second tubular section, and the second extension of the second tubular section received in the second slot of the first tubular section.

37. A method of adjusting a generally cylindrical, tunable microwave applicator of the type having moveable opposed first and second end walls at respective ends of a cylindrical cavity and a product passageway extending through the cylindrical cavity, the method comprising:

a) loading the passageway with the product;

b) adjusting the impedance between a source of relatively low microwave power and the cavity to reduce reflected microwave power; and c) moving the product through the passageway while simultaneously applying a source of relatively high microwave power to obtain a desired treatment of the product and adjusting at least one of the first and second end walls to obtain a low reflected power from the cavity.

38. The method of claim 37 further comprising the additional steps of:

d) stopping the process and switching to the relatively low microwave power;

e) adjusting the impedance to obtain a desired bandwidth for a standing wave ratio characteristic of the cavity; and f) resuming moving the product through the passageway while using the relatively high microwave power.

39. The method of claim 38 where in step f) further comprises simultaneously adjusting at least one of the first and second end walls to minimize reflected power from the cavity.

40. The method of claim 37 wherein step c) further comprises adjusting at least one of the first and second end walls to minimize reflected power while moving product through the passageway and applying relatively high microwave power to the product.

41. The method of claim 37 wherein step a) further comprises loading the passageway with product that has been subjected to the relatively high microwave power.

42. The method of claim 37 wherein step b) further comprises widening the bandwidth of the standing wave ratio characteristic to overcouple the microwave power to the cavity.

43. The method of claim 38 wherein step e) further comprises widening the bandwidth of the standing wave ratio characteristic to overcouple the microwave power to the cavity.

* * * * *